US005375522A

United States Patent [19]

Junghans

[11] Patent Number: 5,375,522

[45] Date of Patent: Dec. 27, 1994

[54] METHOD AND APPARATUS FOR WASHING A PRINTING PRESS IN CONJUNCTION WITH A DAMPING UNIT

[75] Inventor: Rudi Junghans, Wilhelmsfeld, Germany

[73] Assignee: Heidelberger Druckmaschinen AG, Heidelberg, Germany

[21] Appl. No.: 931,259

[22] Filed: Aug. 17, 1992

[30] Foreign Application Priority Data

Aug. 22, 1991 [DE] Germany ..... 9110345[U]

[51] Int. Cl.[5] ..... B41F 35/00

[52] U.S. Cl. ..... 101/424; 101/425

[58] Field of Search ..... 101/424, 423, 425, 148, 101/349, 350

[56] References Cited

U.S. PATENT DOCUMENTS

| | | | |
|---|---|---|---|
| 3,701,316 | 10/1972 | Sylvester et al. | 101/425 |
| 3,842,735 | 10/1974 | Southam et al. | 101/425 |
| 4,130,057 | 12/1978 | List et al. | 101/148 |
| 4,922,818 | 5/1990 | Junghans | 101/350 |
| 5,046,416 | 9/1991 | Freyer et al. | 101/425 |
| 5,086,696 | 2/1992 | Junghans | 101/349 |
| 5,174,209 | 12/1992 | Rodi et al. | 101/424 |

FOREIGN PATENT DOCUMENTS

| | | |
|---|---|---|
| 2077660 | 12/1981 | United Kingdom . |
| 2208626 | 4/1989 | United Kingdom . |
| 2212106 | 7/1989 | United Kingdom . |

*Primary Examiner*—Edgar S. Burr
*Assistant Examiner*—Anthony H. Nguyen
*Attorney, Agent, or Firm*—Nils H. Ljungman & Associates

[57] ABSTRACT

A method of washing a printing press with a washing apparatus, wherein the washing apparatus is configured to provide washing solution to several of the rollers and cylinders of the printing press for washing the rollers and cylinders. Effective washing of various rollers and cylinders of the printing press, and especially the transfer of washing solution to various rollers and cylinders, including the rollers and cylinders of the damping unit, is facilitated while the transfer of washing solution to the damping medium reservoir is generally avoided.

17 Claims, 5 Drawing Sheets

METHOD AND APPARATUS FOR WASHING A PRINTING PRESS IN CONJUNCTION WITH A DAMPING UNIT

BACKGROUND OF THE INVENTION

1. Field of the Invention

The present invention generally relates to a method of washing a printing press with a washing apparatus. Such a printing press typically includes an inking unit, a blanket cylinder, a plate cylinder, and a damping unit, as well as a washing unit. The washing unit is configured to provide washing solution to several of the rollers and cylinders of the printing press for washing the rollers and cylinders.

2. Background Information

Generally, heretofore, a problem often encountered in the washing of printing presses has been the unwanted transfer of washing solution to the damping medium reservoir of the damping unit. Particularly, known methods of washing printing presses have generally involved the transfer of washing solution to the rollers of the damping unit, and thence to the damping medium reservoir. Such a phenomenon has generally been regarded as undesirable.

OBJECT OF THE INVENTION

Generally, it is an object of the present invention to facilitate the effective washing of various rollers and cylinders of the printing press, and especially to facilitate the transfer of washing solution to various rollers and cylinders, including the rollers and cylinders of the damping unit, while generally avoiding the transfer of washing solution to the damping medium reservoir.

SUMMARY OF THE INVENTION

In summary, one aspect of the invention resides in a method for washing the cylinders and the rollers of an offset printing press, the offset printing press including: an inking unit; a blanket cylinder; a plate cylinder being disposed adjacent the blanket cylinder; a washing unit for supplying a washing solution to the blanket cylinder and being disposed adjacent the blanket cylinder; and a damping unit, the damping unit comprising: a damping medium reservoir for containing damping medium, a form roller, being disposed adjacent the plate cylinder, for transferring damping medium to the plate cylinder, a metering roller, being disposed adjacent the damping unit form roller, for transferring damping medium to the damping unit form roller, and means for transferring damping medium between the damping medium reservoir and the damping unit metering roller, the damping medium transferring means being selectively engageable with the damping medium metering roller; the method comprising the steps of: transferring washing solution from the washing unit to the blanket cylinder; transferring washing solution from the blanket cylinder to the plate cylinder; transferring washing solution from the plate cylinder to the damping unit form roller; transferring washing solution from the damping unit form roller to the damping unit metering roller; washing, by means of the washing solution, the blanket cylinder, the plate cylinder, the damping unit form roller and the damping unit metering roller; and disengaging the damping medium transferring means from the damping unit metering roller to prevent the transfer of washing solution from the damping unit metering roller to the damping medium transferring means and the damping medium reservoir.

BRIEF DESCRIPTION OF THE DRAWINGS

A specimen embodiment of the invention is schematically represented in the drawings, wherein.

DESCRIPTION OF THE PREFERRED EMBODIMENTS

Figure 1:
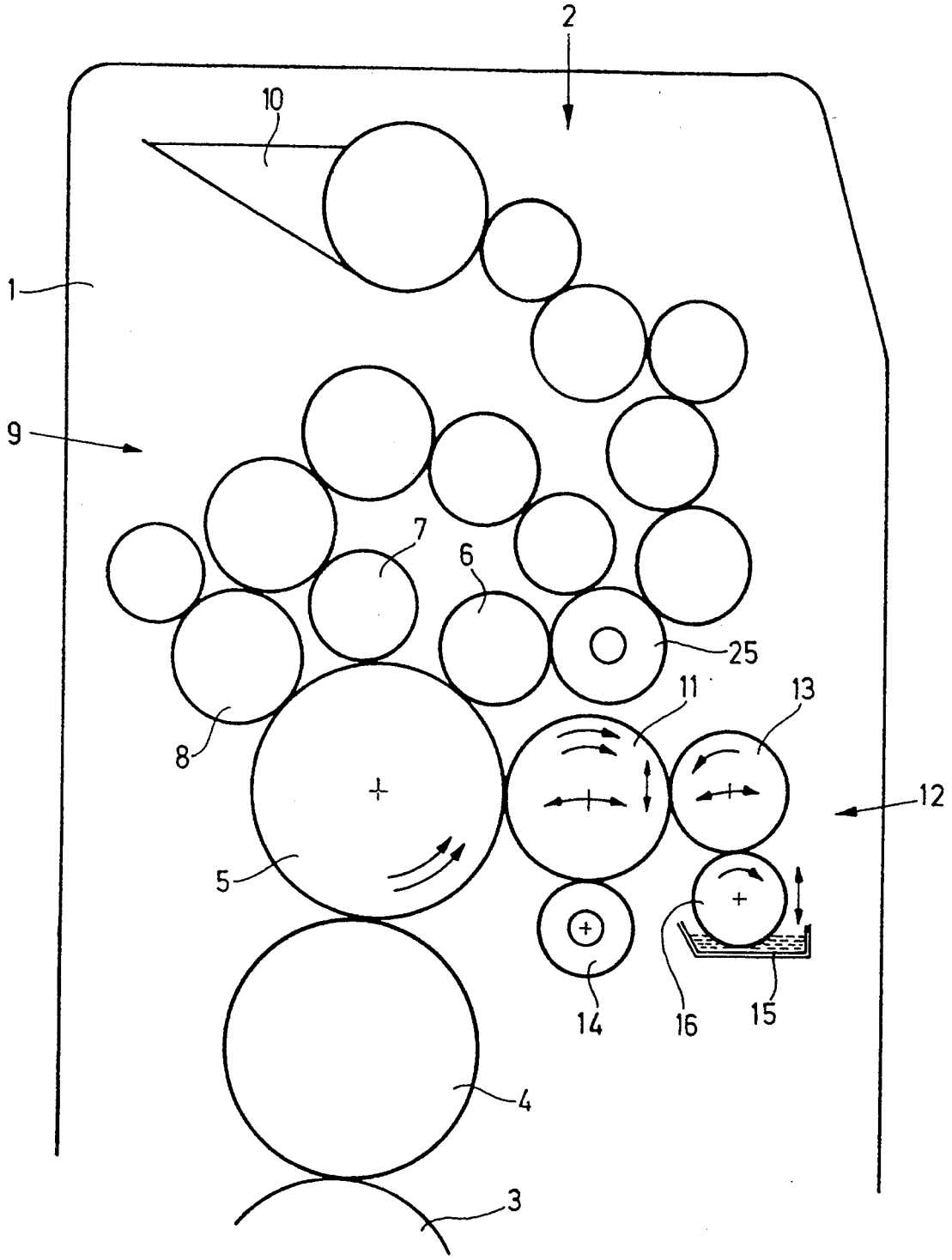
FIG. 1 is a side view of a printing unit having an inking unit and a dampening unit.

According to FIG. 1, an impression cylinder 3, blanket cylinder 4 and plate cylinder 5 are disposed between side frames 1 of the printing unit 2 in a known manner. Form rollers 6, 7, 8 which, in a known manner, are supplied by the inking unit 9 with ink contained in an ink fountain 10, are assigned to the plate cylinder 5.

Viewed in direction of rotation of the plate cylinder 5, which direction is indicated by arrows in the drawings, a form roller 11 of a dampening unit 12 is followed by the form rollers 6, 7, and 8. A metering roller 13 for the dampening unit and a dampening distributor roller 14 are preferably both in rolling contact with the forme roller 11. The required dampening medium is removed by a pan roller 16 from a dampening-medium pan 15 and transferred to the metering roller 13. The form roller 11 and the form rollers 6, 7, 8 are preferably mounted so as to be engageable with and disengageable from the plate cylinder 5. Furthermore, the metering roller 13 is preferably engageable with and disengagable from the forme roller 11, respectively, in order to interrupt the dampening-medium supply. In the specimen embodiment illustrated, the circumferential speed of the forme roller 11 may correspond to that of the plate cylinder 5, and the metering roller 13 may be moved at a lower circumferential speed. Such a dampening unit may be used to print sheets or webs.

Figure 2:
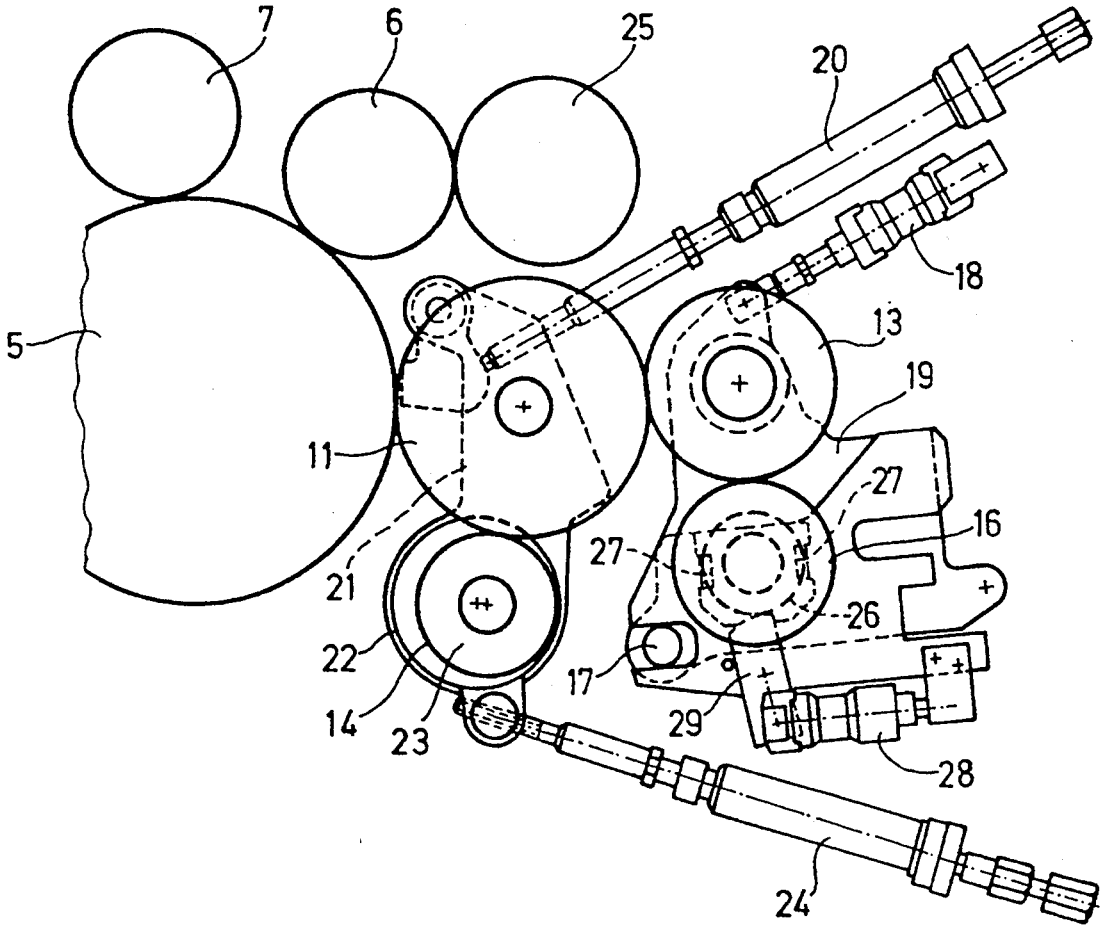
FIG. 2 is a side view of the dampening unit.
Figure 3:
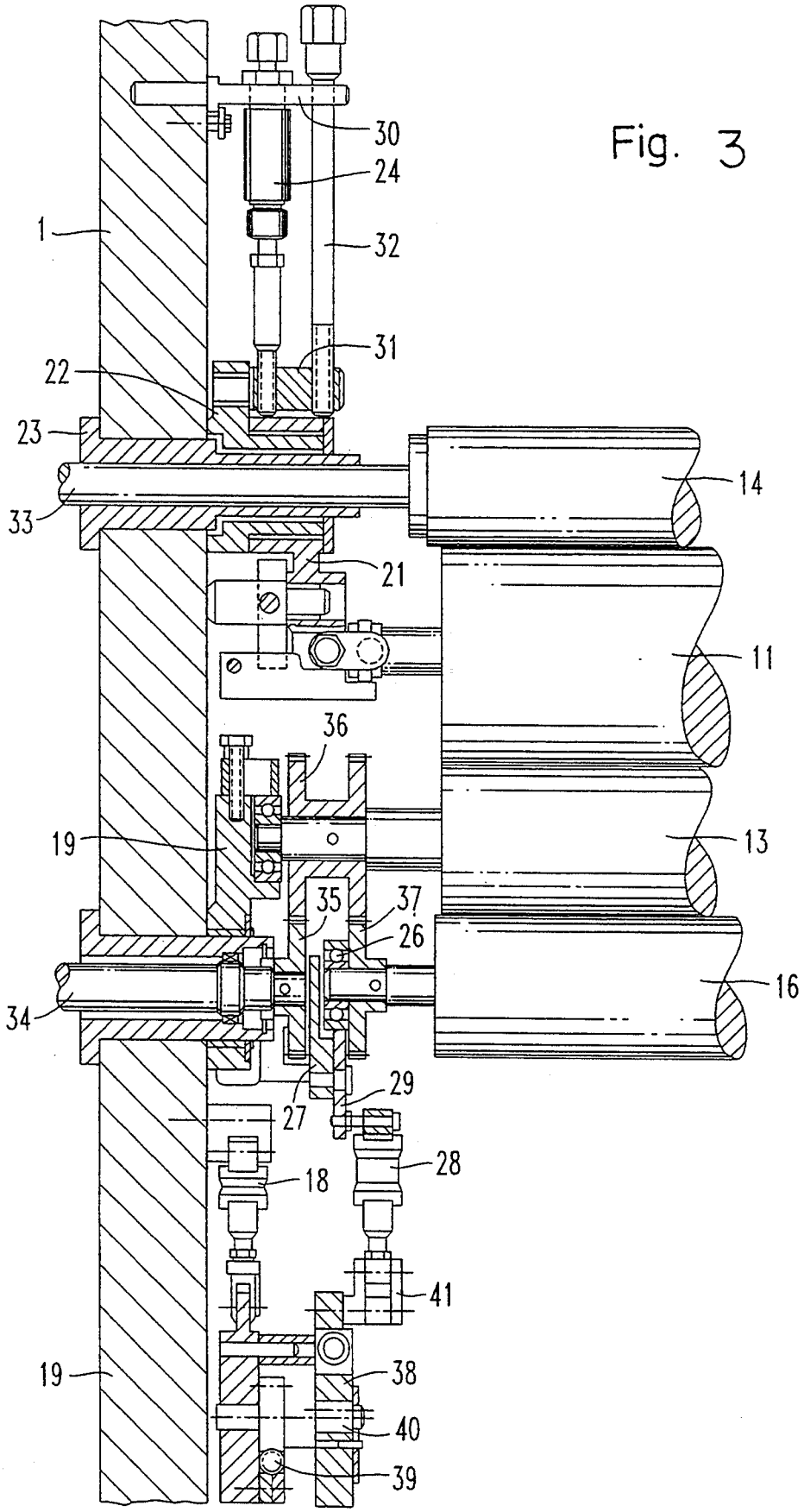
FIG. 3 is a partial longitudinal section through the bearing of the dampening-unit rollers.

FIG. 2 shows various components of the dampening unit 12, in which the pan roller 16 is pivot-mounted about a pivot 17. The manner in which pivot 17 affords effective pivotal movement of pan roller 16 will be more apparent further below. The metering roller 13 and the pan roller 16 may pivot together about the center of the drive 34 (as best seen in FIG. 3), the pivoting motion being effected by a cylinder 18 subjected to a pressure medium. Due to the pivoting motion, the metering roller 13 can be engaged with and disengaged from the forme roller 11 of the dampening unit, respectively, as required, for example, during impression throw-on and throw-off or when stopping the dampening-medium supply. The side elements 19 receiving the metering roller 13 and the pan roller 16 are preferably disposed between the side frames 1 of the printing unit 2 on both sides thereof.

The form roller 11 may be mounted, at both ends thereof, on a bearing bracket 21 which can be pivoted by an adjusting means 20. By means of an eccentric bushing 22, the respective bearing bracket 21 can be mounted on the bearing 23 of the dampening distributor roller 14. During impression throw-on and throw-off the form roller 11 can be engaged with and disengaged from the plate cylinder 5, respectively, via the adjusting means 20 which is preferably designed as a pneumatic cylinder.

An adjusting arrangement 24 which, too, may be designed as a cylinder subjected to a pressure medium, preferably acts on the eccentric bushing 22. In the position indicated in FIG. 2, the eccentric bushing 22 is adjusted such that the forme roller 11 is in contact with the dampening distributor roller 14. By pivoting the eccentric bushing 22 clockwise by means of the adjusting arrangement 24, the forme roller 11 can be moved upwardly via the two bearing brackets 21; in so doing, it is lifted from the dampening distributor roller 14 and engaged with a roller 25 of the inking unit 9.

With its respective bearing 26, the pan roller 16 is guided, at both ends thereof, in sliding guidances 27 arranged approximately perpendicularly. On both sides thereof, a cam 29 can be pivoted by a further adjusting arrangement 28 such that, in the working position of the pan roller 16, the cam 29 moves the pan roller upwards and engages it with the metering roller 13 (position as indicated). By actuating the adjusting arrangement 28, the cam 29 performs a clockwise pivoting movement and releases the bearing 26 of the pan roller 16 so that the pan roller may be lowered by a few millimeters so that the contact between pan roller and metering roller 13 is interrupted. As shown, adjustment arrangement 28 may also be a cylinder subjected to a pressure medium.

The partial longitudinal section according to FIG. 3 shows, beginning from the top, the bearing of the dampening distributor roller 14, the bearing of the forme roller 11, the bearing of the metering roller 13 and the bearing of the pan roller 16. Below, another partial cross section through the side element 19, including the cylinder 18 and the adjusting means 28, can be seen. Via a panel 30, the adjusting arrangement 24 can be supported at the side frame 1, and via a bolt 31, adjusting arrangement can control the bushing 22, by means of which bushing the adjustment of the forme roller 11 with respect to the dampening distributor roller 14 is effected. A positioning screw 32 is provided parallel to the adjusting means 24, which permits a precise adjustment of the forme roller 11 with respect to the roller 25. Via gearwheels, which are not illustrated, the dampening distributor roller 14 can be driven by means of a journal 33.

Both the metering roller 13 and the pan roller 16 are preferably driven via a drive 34 and gearwheels 35, 36, 37. As shown below, the side element 19 preferably carries a bearing plate 38 which can be adjusted via a worm 39 and an eccentric bolt 40, and against which the adjusting means 28 can be braced via counter-bearing 41.

Figure 4:
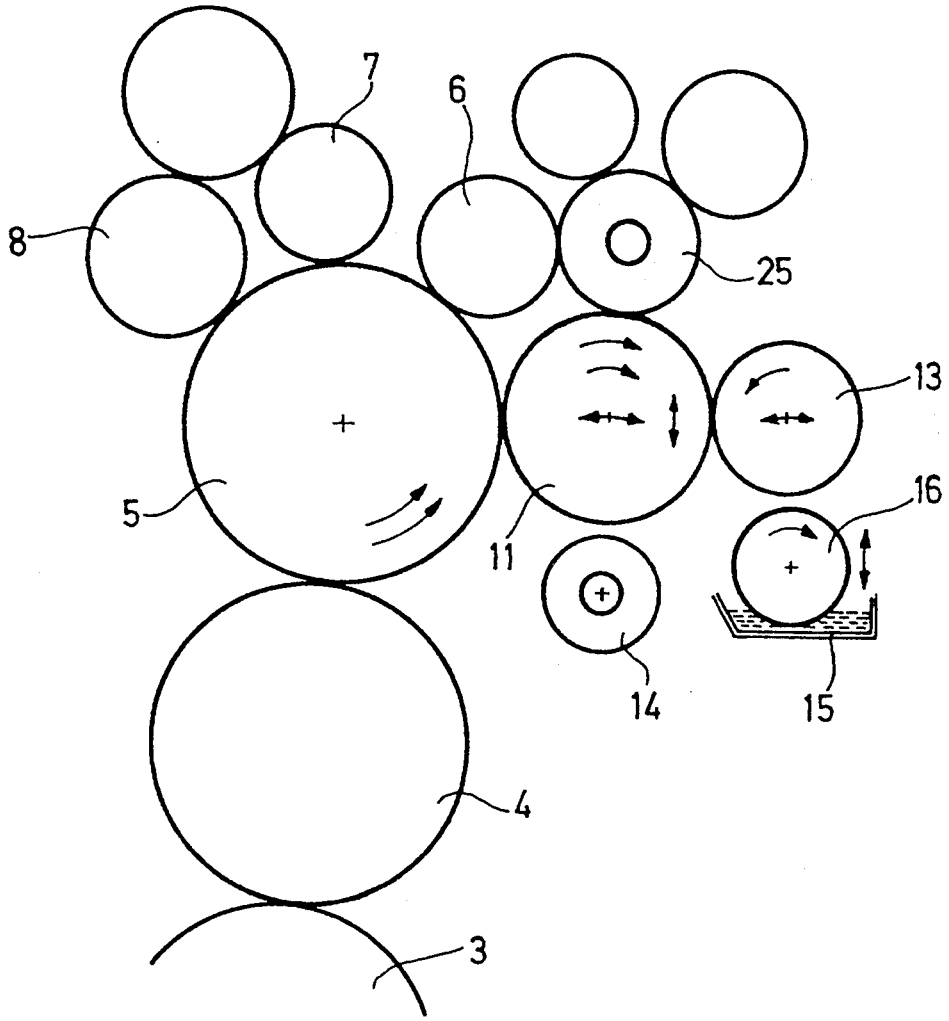
FIG. 4 is a side view of an operating position in which the rollers are washed.

FIG. 4 shows an operating position in which the form roller 11 and the metering roller 13 can be washed, the form roller 11 being in contact with both the plate cylinder 5 and the roller 25. In this case, the metering roller 13 can be engaged with the form roller 11 so that it is possible to wash both metering roller 13 and form roller 11, while preventing the transfer of washing solution to the dampening-medium pan 15. As the dampening distributor roller 14 and the metering roller 13 each have an outer cylindrical surface of chromium and consequently do not attract any ink, the rollers tend not to require washing very often.

Figure 5:
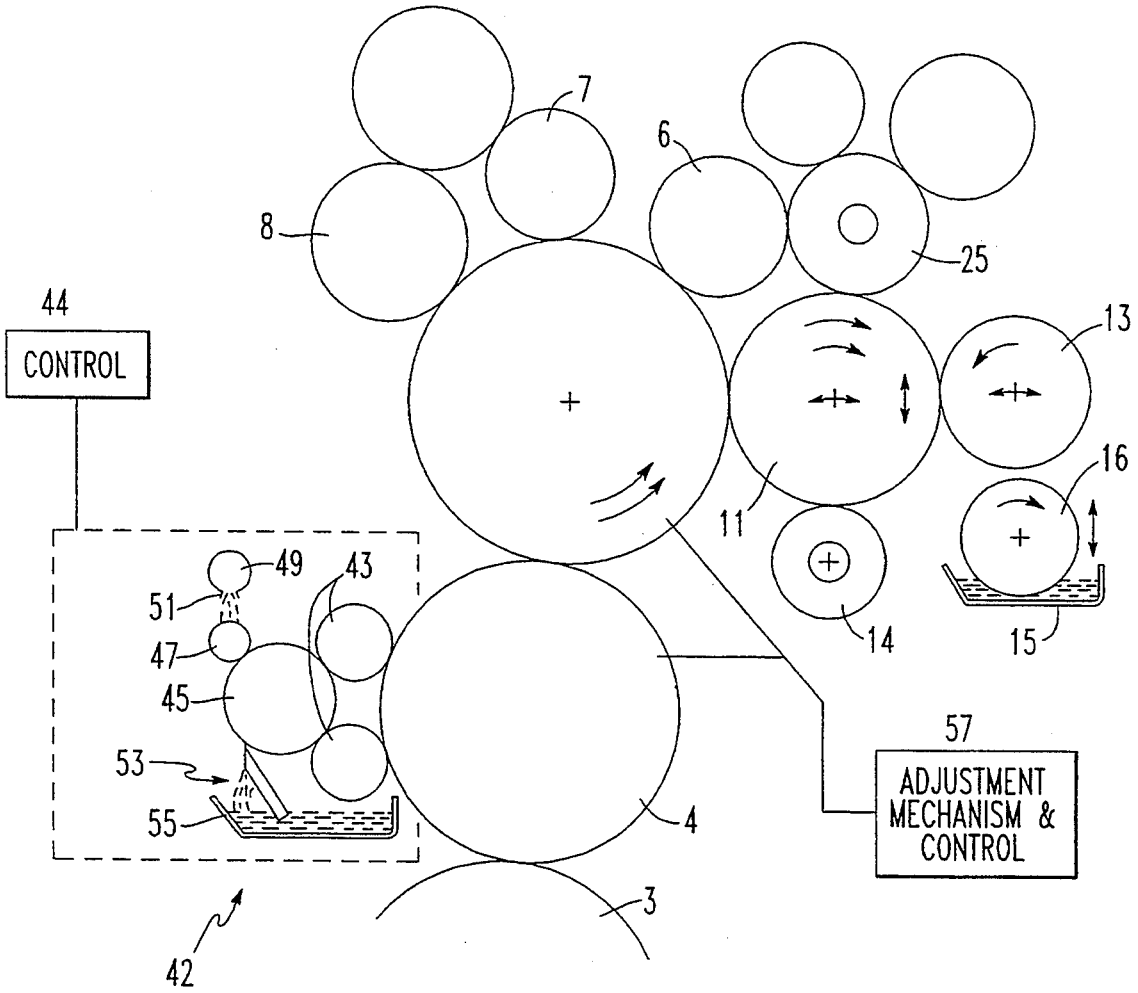
FIG. 5 is substantially the same view as FIG. 4, but additionally illustrating a washing apparatus and controls for use with the printing unit.

FIG. 5 is substantially similar to FIG. 4, but additionally illustrates a washing apparatus 42 and a possible positioning of the washing apparatus 42 with respect to the rest of the printing machine. Preferably, washing apparatus 42 is configured to cooperate with blanket cylinder 4 and to be brought into and out of contact with the outer cylindrical surface of blanket cylinder 4 by means of a control 44. Washing apparatus 42 includes two washing rollers 43 as well as common roller 45 that bridges and interconnects washing rollers 43. Also provided is transfer roller 47, which is in contact with common roller 45 and to which washing liquid 51 can be supplied by a spray apparatus 49, as shown in the drawing, or by a another similar device. A doctor blade apparatus 53 is configured to cooperate with common roller 45 so as to be able to scrape residues from the same. A collection trough 55 is positioned under common roller 45 for collecting excess washing liquid 51. FIG. 5 also shows an adjustment mechanism and control 57 for selectively engaging and disengaging the plate cylinder 5 and the blanket cylinder 4 from each other.

One feature of the invention resides broadly in a dampening unit for an offset printing machine for supplying a plate cylinder with a dampening medium, the dampening unit comprising a form roller, a metering roller, a pan roller immersing in a dampening-medium pan and a dampening distributor roller assigned to the forme roller, the forme roller being mounted so as to be disengageable from the plate cylinder and the metering roller, characterized in that the form roller 11 is mounted so as to be disengageable from the dampening distributor roller 14 and so as to be engageable with a nearest inking-unit roller 25, and that the pan roller 16 is mounted so as to be disengageable from said metering roller 13.

Another feature of the invention resides broadly in a dampening unit characterized in that the form roller 11 is mounted, at both ends thereof, on a respective bearing bracket 21 which can be pivoted by an adjusting means 20, said bearing bracket being mounted, via an eccentric bushing 22, on the bearing 23 of the dampening distributor roller 14 which can be rotated by an adjusting means 24.

Still another feature of the invention resides broadly in a dampening unit characterized in that the respective bearing 26 of the pan roller 16 is guided, at both ends thereof, in a sliding guidance 27 and supported by a cam 29 which can be pivoted by an adjusting means 28.

Examples of washing apparatus for a printing press, which may be utilized with the embodiments of the present invention, may be found in the following copending U.S. patent applications, which are both commonly assigned with the present application and which have both been allowed for issuance as patents: Ser. No. 07/693,233, entitled "Preparation of the Inking Unit of a Printing Press for a Change of Printing Job" and Ser. No. 07/692,380, entitled "A Method of Washing a Printing Press with a Washing Apparatus".

Examples of adjustment mechanisms and controls therefor, which may be utilized with the washing apparatus and the plate and blanket cylinders, in accordance with the present invention, may be found in the two U.S. Patent Applications listed immediately above.

Examples of mechanical arrangements, such as pneumatic cylinders, for selectively shifting rollers and cylinders in a printing press, may be found in the following U.S. Pattests; U.S. Pat. No. 4,922,818 to Junghans, entitled "Wetting/Inking Mechanism for Offset Printing Presses" and U.S. Pat. No. 4,711,172 to Capdebosc, entitled "Machine Having a Plurality of Working Stations for Successively Processing a Sheet of Material Running Through the Machine".

It will be appreciated from the foregoing that the present invention also generally relates to a dampening unit for supplying a dampening medium to a plate cylinder in an offset printing machine, wherein the dampening unit comprises a forme roller, a metering roller, a pan roller immersing in a dampening-medium pan and a dampening distributor roller assigned to the form roller. The form roller and the metering roller are mounted so as to be disengageable, respectively, from the plate cylinder and the form roller.

The German Utility Model No. 87 16 847.2, which corresponds to U.S. Pat. No. 4,922,818, discloses a dampening unit such as that discussed above which, in particular, is provided to print narrower paper webs and to process smaller paper formats without causing an accumulation of dampening medium. Furthermore, this known dampening unit aims at preventing the occurrence of ghosting and channel-caused marks, respectively.

It is an object of the present invention to continue to further optimize the dampening unit in order to create also favorable conditions for special print jobs and for the washing of the inking unit, particularly conditions which permit an automation of the individual working processes. Particularly, it is essentially an object of the present invention to configure the damping unit in such a way that it becomes possible to effectively optimize the flow of damping medium in different types of printing jobs and to facilitate the effective washing of various cylinders and rollers of the printing press. Preferably, the novel configuration of the damping unit permits an automation of various working processes.

In accordance with the present invention, this and other objects are achieved in that the form roller is mounted so as to be disengageable from the dampening distributor roller and so as to be engageable with a nearest inking-unit roller, and in that the pan roller is mounted so as to be disengageable from the metering roller. If the form roller is disengaged from the dampening distributor roller and engaged with the nearest inking-unit roller, this is favorable to the inking of, for example, printing forms having a great deal of color printing patterns, as, in this case, the dampening form roller also supplies the printing forme with ink.

An operating position in which the form roller is engaged with the dampening distributor roller and disengaged from the nearest inking-unit roller is favorable, for example, to the inking of a printing forme having only a few color printing patterns. In this position, less dampening medium enters the inking unit, thus reducing the tendency of the ink to emulsify. When washing the inking unit, the form roller of the dampening unit may be engaged with a roller of the inking unit and be washed as well. In so doing, there is no contact with the dampening distributor roller and the metering roller. In another position, the pan roller is disengaged from the metering roller and the metering roller is engaged with the form roller so that the dampening form roller and the metering roller are simultaneously washed together with the inking unit, preventing the washing solution from getting into the dampening medium.

According to a favorable embodiment, the form roller is mounted, at both ends thereof, in a respective bearing bracket which can be pivoted by an adjusting arrangement, the bearing bracket being mounted via an eccentric bushing on the bearing of the dampening distributor roller rotatable by an adjusting arrangement. In this case, the dampening distributor roller is mounted in the machine side frames and can be connected to the drive of the inking unit. As an example of an adjusting arrangement, pneumatic cylinders can be used so that the respective position can be set via remote operation. In another favorable embodiment of the present invention, the bearing of the pan roller may be guided in a respective sliding guidance at both ends thereof and supported in its working position by a cam which can be pivoted by an adjusting arrangement. As soon as the cam is pivoted away by the adjusting arrangement, the pan roller can be lowered in the sliding guidance by approximately 2 mm so that the contact between pan roller and metering roller is interrupted. During the pivoting motion, the cam presses the pan-roller bearing, and thus the pan roller, back in its working position. These different positions of the pan roller can also be remote-controlled via adjusting means so that the pressman is able to move the rollers into the individual positions depending on the work to be done.

In summary, one aspect of the invention resides broadly in a mechanism for applying at least one of a damping medium and an ink in a printing press, the printing press comprising a plate cylinder, a blanket cylinder being selectively engageable with the plate cylinder, ink reservoir means for containing a supply of the ink, ink transfer means for transferring the ink from the ink reservoir means to the plate cylinder, the ink transfer means comprising: at least a first applicator roller receiving ink from the ink reservoir means, the first applicator roller being in contact with the plate cylinder, and further a first distributor roller comprising a portion of the ink transfer means, the first distributor roller receiving ink from the ink reservoir means, and a washing apparatus being selectively engageable with the blanket cylinder to supply washing fluid to the blanket cylinder for washing at least the blanket cylinder, the mechanism comprising: at least a second applicator roller; a damping medium reservoir for containing a supply of the damping medium; damping medium transfer means for transferring the damping medium from the damping medium reservoir to the second applicator roller; shifting means for selectively shifting the second applicator roller between at least a first position, wherein the second applicator roller is in contact with the plate cylinder and is also in contact with the distributor roller, and a second position, wherein the second applicator roller is in contact with the plate cylinder and is not in contact with the distributor roller; a damping unit roller separate from the damping medium transfer means for contacting the second applicator roller; and means for selectively positioning the damping unit roller and the damping medium transfer means into: a first position, wherein the damping unit roller is engaged with the damping medium transfer means to permit the transfer of damping medium between the damping medium transfer means and the damping unit roller; and a second position, wherein the damping unit roller is disengaged with respect to the damping medium transfer means to prevent: the transfer of damping medium between the damping medium transfer means and the damping unit roller; and the transfer of washing solution from the damping unit roller to the damping medium reservoir.

Another aspect of the invention resides broadly in apparatus for washing the cylinders and the rollers of an offset printing press, the offset printing press including an inking unit, a blanket cylinder, a plate cylinder being selectively engageable with the blanket cylinder, a washing unit for supplying a washing solution to the blanket cylinder and being selectively engageable with the blanket cylinder, and a damping unit, the damping unit comprising: a damping medium reservoir for containing damping medium, a form roller, being selectively engageable with the plate cylinder, for transferring damping medium to the plate cylinder, a metering roller, being selectively engageable with the damping unit form roller, for transferring damping medium to the damping unit form roller, and means for transferring damping medium between the damping medium reservoir and the damping unit metering roller, the damping medium transferring means being selectively engageable with the damping medium metering roller, the apparatus comprising: means for engaging and disengaging the washing unit from the blanket cylinder; means for engaging and disengaging the plate cylinder from the blanket cylinder; means for engaging and disengaging the damping unit form roller from the plate cylinder; means for engaging and disengaging the damping unit metering roller from the damping unit form roller; means for engaging and disengaging the damping medium transferring means from the damping unit metering roller; the apparatus being configured for: transferring washing solution from the washing unit to the blanket cylinder; transferring washing solution from the blanket cylinder to the plate cylinder; transferring washing solution from the plate cylinder to the damping unit forme roller; transferring washing solution from the damping unit forme roller to the damping unit metering roller; washing, by means of the washing solution, the blanket cylinder, the plate cylinder, the damping unit forme roller and the damping unit metering roller; and preventing the transfer of washing solution from the damping unit metering roller to the damping medium transferring means and the damping medium reservoir.

All of the patents, patent applications and publications recited herein, if any, are hereby incorporated by reference as if set forth in their entirety herein.

LIST OF REFERENCE NUMERALS

1 side frame
2 printing unit
3 impression cylinder
4 blanket cylinder
5 plate cylinder
6 form roller
7 form roller
8 form roller
9 inking unit
10 ink pan
11 form roller
12 dampening unit
13 metering roller
14 dampening distributor roller
15 dampening-medium pan
16 pan roller
17 pivot
18 cylinder
19 side element
20 adjusting means
21 bearing bracket
22 bushing
23 bearing
24 adjusting means
25 roller
26 bearing
27 sliding guidance
28 adjusting means
29 cam
30 panel
31 bolt
32 positioning screw
33 journal
34 drive
35 gearwheel
36 gearwheel
37 gearwheel
38 bearing plate
39 worm
40 eccentric bolt
41 counter-bearing
42 washing apparatus
43 washing rollers
44 washing apparatus control
45 common roller
47 transfer roller
49 spray apparatus
51 washing liquid
53 doctor blade apparatus
55 collection trough
57 adjustment mechanism and control

What is claimed is:

1. A method for washing the cylinders end the rollers of an offset printing press, the offset printing press including: an inking unit; a blanket cylinder; a plate cylinder being disposed adjacent the blanket cylinder; a washing unit for supplying a washing solution to the blanket cylinder and being disposed adjacent the blanket cylinder; and a damping unit, the damping unit comprising: a damping medium reservoir for containing damping medium, a form roller, being disposed adjacent the plate cylinder, for transferring damping medium to the plate cylinder, a metering roller, being disposed adjacent the damping unit form roller, for transferring damping medium to the damping unit form roller, and a damping medium transferring roller for transferring damping medium between the damping medium reservoir and the damping unit metering roller, means for selectively engaging the damping medium transferring poller with the damping unit metering roller; said method comprising the steps of:

performing a printing job with the printing press;

performing the following steps during said printing job:

immersing at least a portion of the damping medium transferring roller in the damping medium reservoir to receive damping medium from the damping medium reservoir;

engaging the damping medium transferring roller with the damping unit metering roller;

engaging the damping unit metering roller with the damping unit form roller;

transferring damping medium from the damping medium transferring roller to the damping unit metering roller;

transferring damping medium from the damping unit metering roller to the damping unit form roller;

transferring damping medium from the damping unit form roller to the plate cylinder;

subsequent to said printing job, washing a plurality of cylinders end rollers of the printing press by way of the following steps;

transferring washing solution from the washing unit to the blanket cylinder;

transferring washing solution from the blanket cylinder to the plate cylinder;

transferring washing solution from the plate cylinder to the damping unit form roller;

transferring washing solution from the damping unit form roller to the damping unit metering roller;

washing, by means of the washing solution, the blanket cylinder, the plate cylinder, the damping unit form roller and the damping unit metering roller; and disengaging the damping medium transferring roller from contact with the damping unit metering roller, to prevent, during said washing step, the transfer of washing solution from the damping unit metering roller to the damping medium transferring roller and the damping medium reservoir.

2. The method according to claim 1, wherein the damping unit further comprises a further roller and the inking unit comprises a plurality of inking form rollers, the inking form rollers for being engaged with the plate cylinder for transferring ink to the plate cylinder, the further roller for being engaged with at least one of the inking form rollers, and the damping unit comprises means for selectively engaging the damping unit form roller with the further roller, wherein:

said washing step comprises the step of engaging the damping unit form roller with the further roller.

3. The method according to claim 2, wherein the damping unit comprises a distributor roller, means for selectively engaging the damping unit form roller with the distributor roller, the distributor roller being engageable solely with the damping unit form roller, wherein:

said washing step comprises the step of disengaging the damping unit form roller from the distributor roller.

4. The method according to claim 3, wherein:

the printing press comprises means for selectively engaging the damping unit form roller with the plate cylinder;

said printing job comprises the step of engaging the damping unit form roller with the plate cylinder; and said washing step comprises the step of maintaining the engagement of the damping unit form roller with the plate cylinder.

5. The method according to claim 4, wherein:

the printing press comprises means for selectively engaging the plate cylinder with the blanket cylinder;

said printing job comprises the step of engaging the plate cylinder with the blanket cylinder; and said washing step comprises the step of maintaining the engagement of the plate cylinder with the blanket cylinder.

6. The method according to claim 5, wherein the damping unit further comprises:

the damping medium transferring roller consisting of a sole pan roller, the pan roller being engageable with the damping medium metering roller for transferring damping medium directly from the damping medium reservoir to the damping medium metering roller, the damping unit metering roller and the pan roller each being rotatably mounted on a common frame, the common frame being pivotable about a pivot shaft, means for effecting the pivotal movement of the common frame, a subsidiary frame being pivotally mounted on the common frame, the pan roller being mounted on the subsidiary frame, means for effecting the pivotal movement of the subsidiary frame to selectively engage the pan roller with the damping unit metering roller, the distributor roller comprising a bearing, the damping medium form roller being mounted on a bearing bracket, the bearing bracket being pivotable, dual means for effecting the pivotal movement of the bearing bracket, to selectively engage the damping medium form roller with the distributor roller, to selectively engage the damping medium form roller with the further roller and to selectively engage the damping medium form roller with the plate cylinder, the bearing bracket comprising an eccentric bushing, the bearing bracket being mounted, by means of the eccentric bushing, on the bearing of the distributor roller, the bearing bracket being mounted for pivotal movement about the bearing shaft, the means for effecting the pivotal movement of the common frame comprising at least one hydraulic cylinder, the means for effecting the pivotal movement of the subsidiary frame comprising at least one hydraulic cylinder, the dual means for effecting the pivotal movement of the bearing bracket comprising at least two hydraulic cylinders, the washing unit comprising:

a spray apparatus for providing washing solution;

a first roller disposed adjacent the spray apparatus for receiving washing solution from the spray apparatus;

a second roller, engaged with the first roller, for receiving washing solution from the first roller;

a pair of applicator rollers, engaged with the second roller and for being engaged with the blanket cylinder, for transferring washing solution from the second roller to the blanket cylinder and for transferring residues from the blanket cylinder to the second roller;

doctor blade means being engageable with the second roller for scraping residues from the second roller; and collection trough means for collecting residues scraped by the doctor blade;

wherein:

said washing step comprises the steps of:

pivoting the subsidiary frame to disengage the pan roller from the damping unit metering roller;

pivoting the common frame to engage the damping unit metering roller with the damping unit form roller, pivoting the bearing bracket, by means of the first of the dual pivoting means, to engage the damping unit form roller with the plate cylinder;

pivoting the bearing bracket, by means of the second dual pivoting means, to engage the damping unit form roller with the further roller and to disengage the damping unit form roller from the second distributor roller;

transferring washing solution from the spray apparatus to the first roller of the washing unit;

transferring washing solution from the first roller of the washing unit to the second roller of the washing unit;

transferring washing solution from the second roller of the washing unit to the applicator rollers of the washing unit;

transferring residues from the blanket cylinder to the applicator rollers of the washing unit;

transferring residues from the applicator rollers of the washing unit to the second roller of the washing unit:

scraping residues from the second roller of the washing unit; and collecting the scraped residues in the collection trough means.

7. A mechanism for applying at least one of a damping medium and an ink in a printing press, said printing press comprising: a plate cylinder; a blanket cylinder; means for selectively engaging said blanket cylinder with said plate cylinder; ink reservoir means for containing a supply of the ink; ink transfer means for transferring the ink from said ink reservoir means to said plate cylinder, said ink transfer means comprising: at least a first applicator roller receiving ink from said ink reservoir means, said first applicator roller being in contact with said plate cylinder, and a further roller, said further roller for receiving a portion of the ink transferred from said ink reservoir means; a washing apparatus for supplying washing fluid to said blanket cylinder for washing at least said blanket cylinder; and means for selectively engaging said washing apparatus with said blanket cylinder; said mechanism comprising:

at least a second applicator roller;

a damping medium reservoir for containing a supply of said damping medium;

a damping medium transfer roller being disposed and configured for being at least partly immersed in said damping medium reservoir for receiving damping medium from said damping medium reservoir;

shifting means for selectively shifting said second applicator roller between at least a first position, wherein said second applicator roller is in contact with said plate cylinder and is also in contact with said further roller, and a second position, wherein said second applicator roller is in contact with said plate cylinder and is not in contact with said further roller;

a damping unit roller, separate from said damping medium transfer roller, for contacting said second applicator roller;

said damping medium transfer roller for transferring said damping medium between said damping medium reservoir and said damping unit roller;

said damping unit roller for transferring said damping medium between said damping medium transfer roller and said second applicator roller;

means for maintaining contact between said damping unit roller and said second applicator roller during a washing operation; and means for moving said damping medium transfer roller to selectively position said damping medium transfer roller into:

a first position, wherein said damping medium transfer roller is engaged with said damping unit roller to permit the transfer of damping medium between said damping medium transfer roller and said damping unit roller during a printing job; and a second position, wherein said damping medium transfer roller is disengaged from contact with said damping unit roller to prevent, during a washing operation:

the transfer of damping medium between said damping medium transfer roller and said damping unit roller; and the transfer of washing solution from said damping unit roller to said damping medium transfer roller and said damping medium reservoir.

8. The mechanism according to claim 7, wherein said damping unit roller is a damping unit metering roller and said second applicator roller is a damping medium form roller.

9. The mechanism according to claim 8, further comprising means for selectively engaging said damping unit form roller with said plate cylinder.

10. The mechanism according to claim 9, wherein said means for maintaining contact between said damping unit roller and said second applicator roller comprises means for engaging end disengaging said damping unit metering roller from said damping unit forme roller.

11. The mechanism according to claim 10, further comprising:

a distributor roller being disposed adjacent said damping unit form roller; and means for selectively engaging said damping unit forme roller with said distributor roller, said distributor roller being engageable solely with said damping unit form roller and being engaged with said damping unit form roller when said damping unit form roller is in said first position.

12. The mechanism according to claim 11, further comprising:

said damping medium transferring roller consisting of a sole pan roller, said pan roller being engageable with said damping medium metering roller and being configured for transferring damping medium directly from said damping medium reservoir to said damping medium metering roller;

said damping unit metering roller and said pan roller each being rotatably mounted on a common frame, said common frame being pivotable about a pivot shaft;

means for affecting the pivotal movement of said common frame;

a subsidiary frame being pivotally mounted on said common frame;

said pan roller being mounted on said subsidiary frame;

means for affecting the pivotal movement of said subsidiary frame to selectively engage the pan roller with the damping unit metering roller;

said distributor roller comprising a bearing;

said damping medium form roller being mounted on a bearing bracket, said bearing bracket being pivotable;

dual means for affecting the pivotal movement of said bearing bracket, to selectively engage the damping medium form roller with the distributor roller, to selectively engage the damping medium form roller with the further roller and to selectively engage the damping medium form roller with the plate cylinder;

said bearing bracket comprising an eccentric bushing;

said bearing bracket being mounted, by means of said eccentric bushing, on said bearing of said distributor roller;

said bearing bracket being mounted for pivotal movement about said bearing shaft;

said means for affecting the pivotal movement of said common frame comprising at least one hydraulic cylinder, said means for affecting the pivotal movement of said subsidiary frame comprising at least one hydraulic cylinder, said dual means for affecting the pivotal movement of said bearing bracket comprising at least two hydraulic cylinders, said means for moving said damping medium transferring roller comprising said means for pivoting said subsidiary frame;

said means for engaging said damping unit metering roller with said damping unit forms roller comprising said means for pivoting said common frame;

said means for engaging said damping unit forms roller with said first distributor roller and said means for engaging said damping unit forms roller with said second distributor roller comprising a first of said dual means for affecting the pivotal movement of said bearing bracket;

said means for engaging said damping unit form roller with said plate cylinder comprising a second of said dual means for affecting the pivotal movement of said bearing bracket; and said washing unit comprising:

a spray apparatus for providing washing solution;

a first roller disposed adjacent said spray apparatus for receiving washing solution from said spray apparatus;

a second roller, engaged with said first roller, for receiving washing solution from said first roller;

a pair of applicator rollers, engaged with said second roller and for being engaged with said blanket cylinder, for transferring washing solution from said second roller to said blanket cylinder and for transferring residues from said blanket cylinder to said second roller;

doctor blade means being engageable with said second roller for scraping residues from said second roller; and collection trough means for collecting residues scraped by said doctor blade.

13. Apparatus for washing the cylinders and the rollers of an offset printing press, said offset printing press including an inking unit, a blanket cylinder, a plate cylinder being selectively engageable with said blanket cylinder, a washing unit for supplying a washing solution to said blanket cylinder and being disposed adjacent said blanket cylinder, and a damping unit, said damping unit comprising:

a damping medium reservoir for containing damping medium, a form roller, being disposed adjacent said plate cylinder, for transferring damping medium to said plate cylinder, a metering roller, being disposed adjacent said damping unit form roller, for transferring damping medium to said damping unit form roller, a damping medium transferring roller for transferring damping medium between said damping medium reservoir and said damping unit metering roller, said damping medium transferring roller being disposed adjacent said damping medium metering roller, said damping medium transferring means comprising a damping medium transferring roller, and said damping medium transferring roller being disposed and configured for being at least partly immersed in said damping medium reservoir to receive damping medium from the damping medium reservoir;

said apparatus comprising:

means for selectively engaging said washing unit with said blanket cylinder;

means for selectively engaging said plate cylinder with said blanket cylinder;

means for selectively engaging said damping unit form roller with said plate cylinder;

means for selectively engaging said damping unit metering roller with said damping unit form roller;

said means for selectively engaging said damping unit metering roller with respect to said damping unit form roller comprising means for maintaining contact between said damping unit metering roller and said damping unit form roller during a washing operation;

means for moving said damping medium transferring roller to selectively disengage said damping medium transferring roller from contact with said damping unit metering roller to prevent, during a washing operation, the transfer of washing solution from said damping solution from said damping unit metering roller to said damping medium transferring roller and said damping medium reservoir; said apparatus being configured for:

transferring washing solution from said washing unit to said blanket cylinder;

transferring washing solution from said blanket cylinder to said plate cylinder;

transferring washing solution from said plate cylinder to said damping unit forme roller;

transferring washing solution from said damping unit forme roller to said damping unit metering roller;

washing, by means of said washing solution, said blanket cylinder, said plate cylinder, said damping unit forme roller and said damping unit metering roller; and preventing, during a washing operation, the transfer of washing solution from said damping unit metering roller to said damping medium transferring roller and said damping medium reservoir.

14. The apparatus according to claim 13, further comprising:

a distributor roller being disposed adjacent said damping unit form roller; and means for selectively engaging said damping unit forme roller with said distributor roller, said distributor roller being engageable solely with said damping unit form roller.

15. The apparatus according to claim 14, wherein said damping medium transferring roller consists of a sole pan roller, said pan roller being engageable with said damping medium metering roller and being configured for transferring damping medium directly from said damping medium reservoir to said damping medium metering roller.

16. The apparatus according to claim 15, further comprising:

said damping unit metering roller and said pan roller each being rotatably mounted on a common frame, said common frame being pivotable about a pivot shaft;

means for effecting the pivotal movement of said common frame;

a subsidiary frame being pivotally mounted on said common frame;

said pan roller being mounted on said subsidiary frame; and means for effecting the pivotal movement of said subsidiary frame.

17. The apparatus according to claim 16, further comprising:

said second distributor roller comprising a bearing, said damping medium forms roller being mounted on a bearing bracket, said bearing bracket being pivotable, said distributor roller comprising a bearing;

said damping medium form roller being mounted on a bearing bracket, said bearing bracket being pivotable;

dual means for effecting the pivotal movement of said bearing bracket, to selectively engage the damping medium form roller with the distributor roller, to selectively engage the damping medium form roller with the further roller and to selectively engage the damping medium form roller with the plate cylinder;

said bearing bracket comprising an eccentric bushing;

said bearing bracket being mounted, by means of said eccentric bushing, on said bearing of said distributor roller;

said bearing bracket being mounted for pivotal movement about said bearing shaft;

said means for affecting the pivotal movement of said common frame comprising at least one hydraulic cylinder, said means for effecting the pivotal movement of said subsidiary frame comprising at least one hydraulic cylinder, said dual means for affecting the pivotal movement of said bearing bracket comprising at least two hydraulic cylinders, said means for moving said damping medium transferring roller comprising said means for pivoting said subsidiary frame;

said means for engaging said damping unit metering roller with said damping unit forms roller comprising said means for pivoting said common frame;

said means for engaging said damping unit forms roller with said first distributor roller and said means for engaging said damping unit forme roller with said second distributor roller comprising a first of said dual means for affecting the pivotal movement of said bearing bracket;

said means for engaging said damping unit form roller with said plate cylinder comprising a second of said dual means for effecting the pivotal movement of said bearing bracket; and said washing unit comprising:

a spray apparatus for providing washing solution;

a first roller disposed adjacent said spray apparatus for receiving washing solution from said spray apparatus;

a second roller, engaged with said first roller, for receiving washing solution from said first roller;

a pair of applicator rollers, engaged with said second roller and for being engaged with said blanket cylinder, for transferring washing solution from said second roller to said blanket cylinder and for transferring residues from said blanket cylinder to said second roller;

doctor blade means being engageable with said second roller for scraping residues from said second roller; and collection trough means for collecting residues scraped by said doctor blade.

* * * * *

UNITED STATES PATENT AND TRADEMARK OFFICE

CERTIFICATE OF CORRECTION

PATENT NO. : 5,375,522

DATED : December 27, 1994

INVENTOR(S) : Rudi JUNGHANS

It is certified that error appears in the above-indentified patent and that said Letters Patent is hereby corrected as shown below:

In Column 4, line 66, after the first occurrence of 'U.S.' delete "Pattests;" and insert --Patents:--.

In Column 8, line 30, Claim 1, after 'cylinders' delete "end" and insert --and--.

In Column 8, line 47, Claim 1, delete "poller" and insert --roller--.

In Column 9, line 2, Claim 1, after 'cylinders' delete "end" and insert --and--.

In Column 12, line 30, Claim 10, after 'engaging' delete "end" and insert --and--.

In Column 13, line 34, Claim 12, after 'for' delete "affecting" and insert --effecting--.

In Column 13, line 38, Claim 12, after 'for' delete "affecting" and insert --effecting--.

UNITED STATES PATENT AND TRADEMARK OFFICE

CERTIFICATE OF CORRECTION

PATENT NO. : 5,375,522

DATED : December 27, 1994

INVENTOR(S) : Rudi JUNGHANS

It is certified that error appears in the above-indentified patent and that said Letters Patent is hereby corrected as shown below:

In Column 16, line 3, Claim 17, after 'for' delete "affecting' and insert --effecting--.

In Column 16, line 9, Claim 17, after 'for' delete "affecting" and insert --effecting--.

Signed and Sealed this

Twentieth Day of August, 1996

Bruce Lehman

*Attest:*

BRUCE LEHMAN

*Attesting Officer*

*Commissioner of Patents and Trademarks*